United States Patent [19]

Reigner et al.

[11] 4,400,959

[45] Aug. 30, 1983

[54] EXTRUDER FOR THE FORMATION OF A BRANCH ON A PIPE

[75] Inventors: Gérard Reigner, La Guerche-de-Bretagne; Yves Bréger, Laval, both of France

[73] Assignee: Europe Outillage S.A., La Guerche-de-Bretagne, France

[21] Appl. No.: 255,481

[22] Filed: Apr. 20, 1981

[30] Foreign Application Priority Data

Apr. 24, 1980 [FR] France ..... 80 09269

[51] Int. Cl.[3] ..... B21D 19/00

[52] U.S. Cl. ..... 72/112; 72/479; 29/157 T

[58] Field of Search ..... 72/112, 115, 120, 125, 72/370, 117, 479, 71, 367; 29/157 T

[56] References Cited

U.S. PATENT DOCUMENTS

| | | | |
|---|---|---|---|
| 3,468,147 | 9/1969 | Davies | 72/112 |
| 3,817,071 | 6/1974 | Chalvignac | 29/157 T |
| 3,844,149 | 10/1974 | Hansen | 72/120 |
| 4,300,382 | 11/1981 | Meek | 72/478 |

FOREIGN PATENT DOCUMENTS

| | | | |
|---|---|---|---|
| 2512149 | 11/1975 | Fed. Rep. of Germany | 72/117 |
| 2346068 | 10/1977 | France | 72/117 |

*Primary Examiner*—Lowell A. Larson

*Attorney, Agent, or Firm*—Fleit, Jacobson & Cohn

[57] ABSTRACT

An extruder for the formation of a branch on a pipe comprises two arms and a mandrel. The arms are cranked and are pivoted to one another. The extruder is suitable for use when it is desired to connect a branch pipe to a main pipe.

4 Claims, 4 Drawing Figures

EXTRUDER FOR THE FORMATION OF A BRANCH ON A PIPE

The invention relates to the formation of a branch on a pipe.

An extruder is known for the formation of a branch which comprises two arms with cranked ends and a mandrel, as described in U.S. Pat. No. 3,468,147. In this apparatus, the cranked ends of the two arms are introduced obliquely into a lateral opening in the pipe, their dimensions being chosen so that the total width of the two arms is greater than the diameter of the opening. The stems of the two arms are then attached and introduced into the mandrel, which has a lower part able to be supported on the pipe and an upper part to which the stems are fixed. The upper part can be set in rotation with respect to the lower part in order to move progressively away from the latter. This separation causes a corresponding displacement of the arms, which by deformation and drawing of the pipe around the opening produce a branch which facilitates the connection of a branch pipe thereto.

The object of the invention is to provide an improvement of this type of known tool.

According to the present invention there is provided an extruder for the formation of a branch on a pipe after a lateral opening has been provided in the pipe, the extruder comprising, a first arm, a second arm pivoted to the first arm, and a mandrel.

The tool according to the invention has the advantage of being easier to handle than known tools since the two arms may be easily handled together for their introduction into the opening in the pipe, whereas known tools comprising independent arms require greater dexterity and greater freedom for handling, namely for introducing the arms, the operator being preoccupied with keeping the arms in the correct relative positions for their introduction.

This ease of introduction provided by the invention results in a saving of time for carrying out the operation.

Another factor which contributes to the saving of time is that when using known tools, it frequently happens that one of the arms escapes from the user's hand when the latter positions the other arm, which is not possible in the case of the tool according to the invention.

Finally, the arms remain in pairs, which facilitates their storage and prevents them from becoming mixed with arms of different sizes.

A tool according to the present invention will now be described, with reference to the accompanying drawing, in which.

Figure 1:
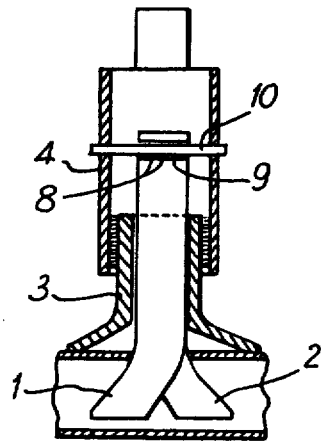
FIG. 1 is a sectional view of an extruder, according to the invention.

In manner known per se, the extruder illustrated in the drawings comprises two identical arms 1,2 and a mandrel in two parts 3,4 (FIG. 1).

Figure 3:
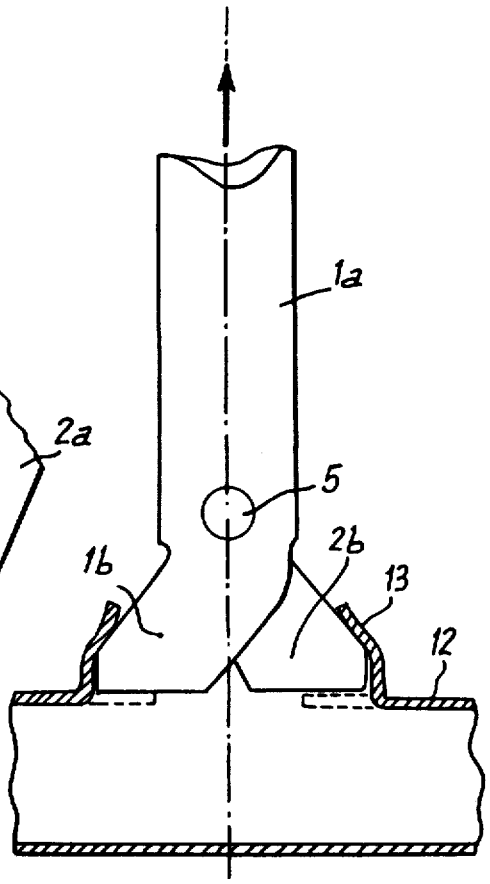
FIGS. 2 and 3 are enlarged views showing the two arms of the extruder, inclined for their introduction into a pipe, and in a straight line for their extraction and the formation of a branch respectively.
Figure 2:
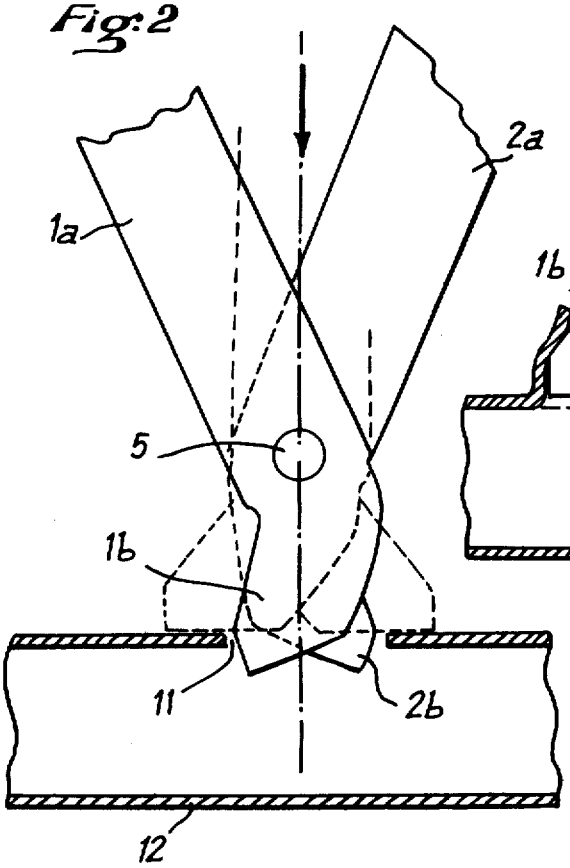

According to the invention, the two arms are kept pressed one against the other, in the manner of the two blades of scissors by a rivet 5 which enables them to pivot (FIGS. 2 and 3).

Figure 4:
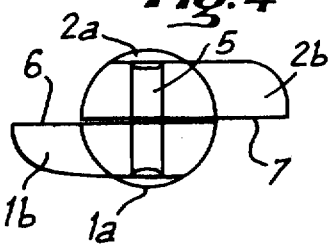
FIG. 4 is a plan view of the two arms.

This rivet is located at the limit of the stems 1*a* (2*a*) and of the bent ends 1*b* (2*b*) of the arms (FIGS. 2 to 4).

According to one feature of this construction, the stem 1*a* (2*a*) and the bent part 1*b* (2*b*) of one arm are located in the same plane 6,7 and the two arms, which each have opposed flat sides in the plane 6,7, are attached through these planes 6,7 (FIG. 4).

The stems preferably have a cross section in the shape of a half circle.

At their upper end, the stems are provided with means for attaching them to the mandrel. These means are for example a common connection in the form of a passage 8,9 for a cotter pin in each stem for cooperating with a cotter pin 10 (FIG. 1). It is possible to use any other known securing means and, for example, a system comprising a bayonet. The invention is not limited to a particular choice of securing means.

The tool of the invention is used like known tools:

the two arms are inclined in order to be introduced into the opening 11 in the pipe 12 (FIG. 2);

the two arms are straightened, engaged in the mandrel and fixed to the rotating part of the latter (FIG. 1);

the rotating part of the mandrel is rotated by hand or by means relative to the pipe opening of a driving device in order to cause the linear ascent of the arms and the formation of the branch by progressive deformation of the region of the pipe 13 surrounding the opening.

The invention can be applied to all metal pipes used for plumbing work (sanitary installations, central heating, pipes carrying fluids etc).

We claim:

1. An extruder for forming a branch on a pipe in which a lateral opening has been provided, said extruder comprising:

(a) a tool defined by a first arm and a second arm, each of said arms having a stem and a bent end at one end of said stem, said arms pivotally connected at a pivot point adjacent said bent ends, said stems each including an upper end having attachment means;

(b) a mandrel having a first part positionable around the lateral opening in the pipe and a second part rotatably positioned relative to said first part for linear movement relative to the pipe opening;

(c) said attachment means on each of said stems engageable with said second part of said mandrel through a common connection; and (d) means to permit rotation of said second part of said mandrel relative to said first part to cause said arms to move laterally relative to the pipe.

2. An extruder as claimed in claim 1 in which a face of said stem and of said bent end of each arm are coplanar.

3. An extruder as claimed in claim 1, in which each of said arms have flat sides which are in contact and which are pivoted together about an axis at right angles to said sides.

4. An extruder as claimed in claim 1 in which said pivot point of each arm is located at the limit of the stem and of the bent end of the arm.

* * * * *